US007319832B2

(12) United States Patent
Nishimura et al.

(10) Patent No.: US 7,319,832 B2
(45) Date of Patent: Jan. 15, 2008

(54) ATTACHING AND DETACHING A PROCESS CARTRIDGE OF AN IMAGE FORMING DEVICE

(75) Inventors: Soichiro Nishimura, Handa (JP); Takahiro Nishimoto, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 135 days.

(21) Appl. No.: 11/139,505

(22) Filed: May 31, 2005

(65) Prior Publication Data

US 2005/0265747 A1 Dec. 1, 2005

(30) Foreign Application Priority Data

May 31, 2004 (JP) ..... 2004-162430

(51) Int. Cl.
*G03G 21/16* (2006.01)

(52) U.S. Cl. ..... 399/111; 399/107; 399/110; 399/121; 399/313

(58) Field of Classification Search ..... 399/107, 399/110, 111, 121, 313
See application file for complete search history.

(56) References Cited

U.S. PATENT DOCUMENTS 5,486,898 A 1/1996 Fujii et al.
5,572,305 A 11/1996 Hayashi et al.
5,867,751 A * 2/1999 Nomura et al. ..... 399/111
5,923,935 A * 7/1999 Yamaguchi ..... 399/121
6,084,622 A * 7/2000 Sugiura et al. ..... 347/170
6,714,750 B2 * 3/2004 Terada et al. ..... 399/111

FOREIGN PATENT DOCUMENTS

JP 05-216356 8/1993
JP 07-152303 6/1995
JP 07-191557 7/1995
JP 07-302007 11/1995
JP 11-052814 2/1999

* cited by examiner

*Primary Examiner*—David M. Gray
*Assistant Examiner*—Ryan D. Walsh
(74) *Attorney, Agent, or Firm*—Banner & Witcoff, Ltd

(57) ABSTRACT

An image forming device is provided with a process cartridge having a image carrying member, a main body including an attaching section to which the process cartridge is detachably attached, and an image transfer member to be press-contacted to the image carrying member for image transfer when the process cartridge is completely attached to the attaching section. The process cartridge may be configured to apply a pressing force to the attaching section when the process cartridge is not completely attached to the attaching section, and the image forming device may further include a separating mechanism configured to allow the press-contact between the image carrying member and the image transfer member when the process cartridge is completely attached to the attaching section, the separating mechanism operating to separate the image carrying member and the image transfer member when the pressing force is applied by the process cartridge to the attaching section.

22 Claims, 10 Drawing Sheets

ATTACHING AND DETACHING A PROCESS CARTRIDGE OF AN IMAGE FORMING DEVICE

CROSS REFERENCE TO RELATED APPLICATION

This application claims priority from Japanese Patent Application No. 2004-162430, filed on May 31, 2004, the entire subject matters of the application are incorporated herein by reference.

BACKGROUND OF THE INVENTION

1. Technical Field

Aspects of the invention relate to an image forming device that forms an image in accordance with an electrophotographic imaging process, and a process cartridge employed in such an image forming device.

2. Related Art

Conventionally, image forming devices that form images in accordance with the electrophotographic image formation process have been known. Typically, such an image forming device has a main body provided with a transfer roller, and a process cartridge detachably attached to the main body. The process cartridge includes a photoconductive drum, and when the process cartridge is attached to the main body of the image forming device, the photoconductive drum and the transfer roller face are press-contacted with each other. In such an imaging device, in a process of detaching/attaching the process cartridge with respect to the main body, the photoconductive drum and the transfer roller may slide-contact each other. In such a case, the surface of the photoconductive drum may be deteriorated and quality of the formed image may be lowered.

To avoid the above problem, Japanese Patent Provisional Publication No. HEI 11-52814 discloses a structure for switching the photoconductive drum and the transfer roller between a press-contacted state and a separated state when a drum unit (i.e., the process cartridge) in response to operation of a lever. When such a structure is employed, by detaching/attaching the drum unit after they are separated, the slide-contact between the photoconductive drum and the transfer roller can be avoided.

In order to realize the structure disclosed in the above-identified publication, a relatively complicated structure including a cam mechanism should be employed. Further, an additional operation of the handle is necessary, which make operability in detaching/attaching the drum unit worse.

SUMMARY OF THE INVENTION

Aspects of the present invention are advantageous in that an improved image forming device and a process cartridge are provided, with which the process cartridge can be attached/detached without the slide-contact between the photoconductive drum and the transfer roller with a relatively simple structure.

BRIEF DESCRIPTION OF THE ACCOMPANYING DRAWINGS

DETAILED DESCRIPTION

Figure 1:
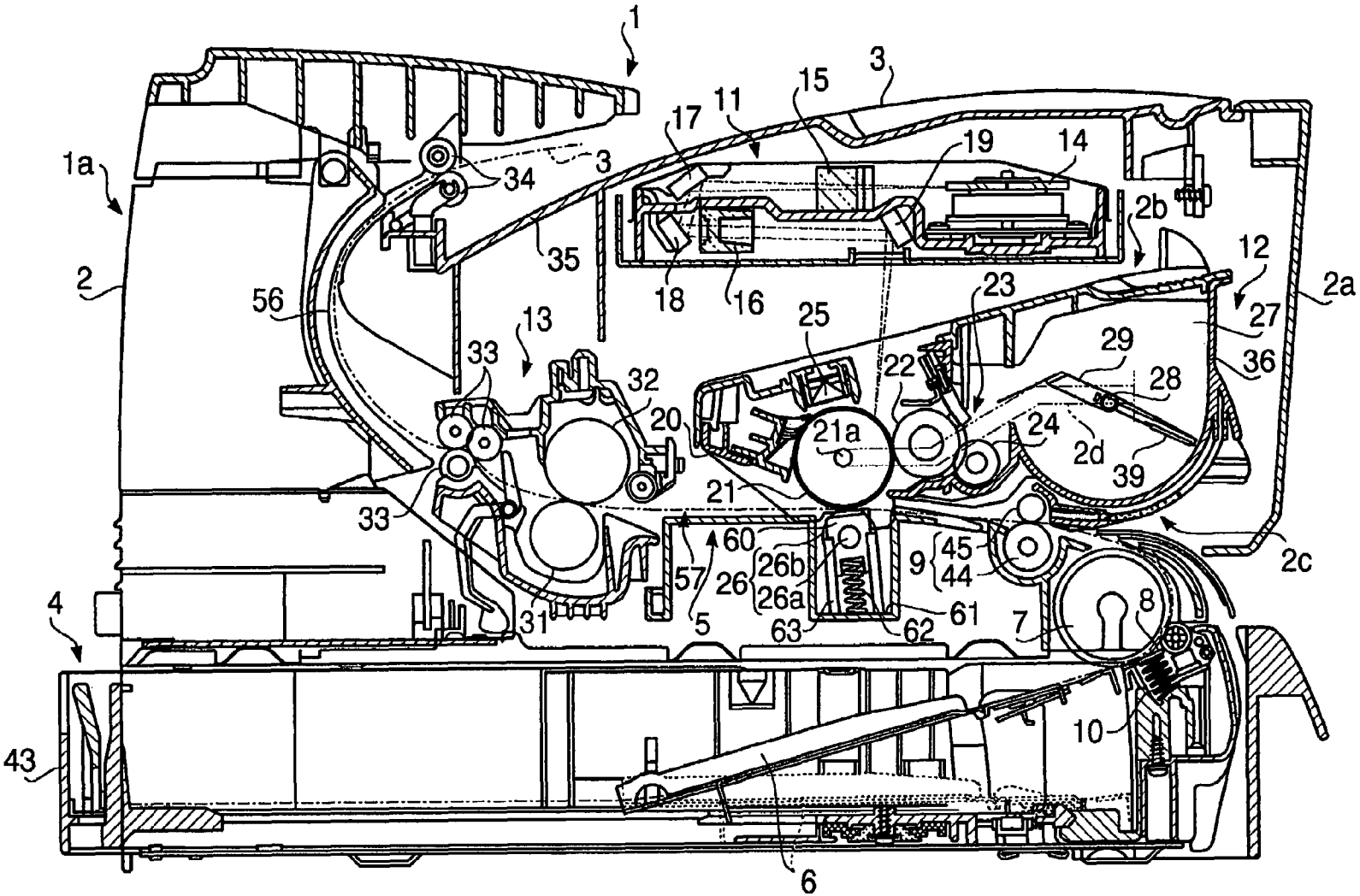
FIG. 1 is a cross-sectional side view showing main components of a laser printer according to a first embodiment.

General Overview of Aspects of the Invention

The following describes general aspects of the invention that may or may not be included in various embodiments/modifications. Also, it is noted that various connections are set forth between elements in the following description. It is noted that these connections in general and, unless specified otherwise, may be direct or indirect and that this specification is not intended to be limiting in this respect.

According to some aspects of the invention there is provided an image forming device, which is provided with a process cartridge having a image carrying member, a main body including an attaching section to which the process cartridge is detachably attached, and an image transfer member to be press-contacted to the image carrying member for image transfer when the process cartridge is completely attached to the attaching section. The the process cartridge may be configured to apply a pressing force to the attaching section when process cartridge is not completely attached to the attaching section, and the image forming device may further include a separating mechanism configured to allow the press-contact between the image carrying member and the image transfer member when the process cartridge is completely attached to the attaching section, the separating mechanism operating to separate the image carrying member and the image transfer member when the pressing force is applied by the process cartridge to the attaching section.

It should be note that the image carrying member may include not only a photoconductive drum, but an intermediate transfer member. Further, the term "image forming device" should not be limited to a printer or a laser printer. The image forming device may include various type of devices such as a facsimile device and an MFP (Multi Function Periphal) having functions of a printer and a facsimile. The term "not completely attached" means any state other that the state where the image transfer member and the image carrying member are contact each other.

Optionally, the pressing force may not be applied to the attaching section when the process cartridge is completely attached to the attaching section.

The main body may include a supporting member that supports the transfer member, and an urging member that urges the supporting member in a direction where the image transfer member is urged toward the image carrying member. The separating mechanism may move the supporting member against the urging force of the urging member to separate the image transfer member from the image carrying member.

The process cartridge may be moved, for attachment/detachment, in a direction substantially perpendicular to a direction in which the image carrying member and image transfer member face each other when the process cartridge is completely attached to the attaching section.

Optionally, the transfer member may transfer an image carried by the image carrying member on a recording medium fed on the image transfer member, and the process cartridge is moved in a direction parallel with the feeding direction of the recording medium when attached to or detached from the attaching section.

Further optionally, the process cartridge may be moved to rotate about an axis that is parallel with a plane on which the image carrying member and the image transfer member are to be press-contacted so as to be completed attached to the attaching section.

The image carrying member and the image transfer member may have rotatable rollers having rotary axes extending in a predetermined same direction, respectively. The rollers may be provided with gears that engage with each other when the process cartridge is completely attached to the attaching section, and the gears of the rollers may be disengaged when the process cartridge is not completely attached to the attaching section.

Optionally, the image forming device may include a positioning structure that adjusts positions of the image carrying member and the image transfer member when the process cartridge is completely attached to the attaching section.

The separating mechanism may further include a protruded portion provided to one of the facing portions of the process cartridge and the main body, and a dent portion provided to the other of the facing portions of the process cartridge and the main body. The press-contact between the image carrying member and the image transfer member may be allowed when the protruded portion enters the dent portion as the process cartridge is completely attached to the attaching section, and the image carrying member and the image transfer member may be separated when the protruded portion interferes with a portion next to the dent portion as the process cartridge is not completely attached to the attaching section.

In the above case, the main body may be provided with a supporting member that supports the transfer member, and an urging member that urges the supporting member in a direction in which the image transfer member faces the image carrying member. Further, the protruded portion may be provided to the supporting member, and the dent portion may be provided to the process cartridge.

Optionally, the protruded portion may be provided to the process cartridge, the protruded portion being protruded outward with respect to an outermost portion of the image carrying member.

Still optionally, the dent portion may be defmed as a portion between two protruded sections, a relative position between the image carrying member and the image transfer member in a direction in which to protruded sections are arranged being adjusted by the two protruded sections when the protruded portion engages with the dent portion as the process cartridge is completely attached to the attaching section.

At least one of the protruded portion and the dent portion may be formed with a tapered surface which enables the image carrying member and the image transfer member to gradually approach when an attaching state of the process cartridge is changes from a non-attached state to a completely attached state.

According to other aspects of the invention, there is provided a process cartridge to be detachably attached to an attaching section of a main body of an image forming device, the process cartridge comprising a image carrying member which is to be press-contacted with an image transfer member provided to the main body when the process cartridge is completely attached to the attaching section. A protruded portion may be provided to one of the facing portions of the process cartridge and the main body, and a dent portion may be provided to the other of the facing portions of the process cartridge and the main body. Further, the press-contact between the image carrying member and the image transfer member may be allowed when the protruded portion enters the dent portion as the process cartridge is completely attached to the attaching section, and the image carrying member and the image transfer member may be separated when the protruded portion interferes with a portion next to the dent portion as the process cartridge is not completely attached to the attaching section.

According to another aspect of the invention, there is provided a process cartridge to be detachably attached to an attaching section of a main body of an image forming device. The process cartridge may include a image carrying member which is to be press-contacted with an image transfer member provided to the main body when the process cartridge is completely attached to the attaching section, and a dent portion in which a protruded portion provided to the main body is inserted when the processing cartridge is completely attached to the attaching section, the image carrying member being press-contacted when the protruded portion is inserted in the dent portion. The protruded portion contacting side portions defining the dent portion when the processing cartridge may not be completely attached to the attaching section, the image carrying member and the image transfer member being spaced from each other when the protruded portion contacts the side portions defining the dent portion.

Optionally, the protruded portion and the dent portion may not contact each other when the process cartridge is completely attached to the attaching section.

Further optionally, the process cartridge may be moved to be attached to or detached from the main body along a direction perpendicular to a direction in which the image carrying member and the image transfer member face each other when the process cartridge is completely attached to the attaching section.

In this case, the process cartridge may be inserted to the attaching section along a direction parallel with a feeding direction of a recording medium fed on the image transfer member.

Optionally, the process cartridge may be attached to the attaching section by a rotation about a side end thereof.

The image carrying member and the image transfer member may respectively have rotatable rollers having rotary axes extending in a predetermined same direction. Further, the rollers are provided with gears that engage with each other when the process cartridge may be completely attached to the attaching section, and the gears of the rollers are disengaged when the process cartridge may not be completely attached to the attaching section.

Further optionally, the protruded portion and the dent portion may be shaped to engage with each other when the process cartridge is completely attached to the attaching section, and a positional relationship between the image carrying member and the image transfer member in a direction in which a recording medium is fed on the image transfer member may be adjusted by the engagement between the protruded portion and the dent portion.

Optionally, at least one of the protruded portion and the dent portion may be formed with a tapered surface which enables the image carrying member and the image transfer member to gradually approach when an attaching state of the process cartridge is changed from a non-attached state to a completely attached state.

According to a further aspect of the invention, there is provided an image forming device, which is provided with a process cartridge having an image carrying member, a main body having including an attaching section to which the process cartridge is detachably attached, an image transfer member supported at the main body, the image transfer member being movable between a first position where the image transfer member is contacted to the image carrying member and a second position where the image transfer member is separated from the image carrying member, and a separating mechanism that communicates with the process cartridge and makes the image transfer member positioned at the second position when the process cartridge is adjacent to the attaching section while the process cartridge is being attached to and being detached from the attaching section.

FIRST EMBODIMENT

Hereinafter, referring to the accompanying drawings, laser beam printers according to first through third embodiments and modifications thereof will be described in detail. It is noted that, in the following description, a right-hand side of FIGS. 1, 2, 3 and 4A-4C is defined as a front side of the laser printer.

FIG. 1 is a cross-sectional side view showing main components of a laser printer 1 according to a first embodiment. The laser printer 1 has a casing 2, which accommodates a feeder unit 4 and image formation unit 5. The feeder unit 4 is configured to feed recording sheets 3 to the inside of the laser printer 1. The image forming unit 5 is configured to form an image on the recording sheet 3 fed from the feeder unit 4.

According to the first embodiment, a process cartridge 12 and a transfer roller 26 are separate members. The transfer roller 26 is fixedly provided inside a main body 1*a* of the laser printer 1, while the process cartridge 12 is detachably attached to the casing 1*a*. Further, on a front surface of the casing 2 (i.e., the right-hand side of the casing 2 in FIG. 1), an openable/closable door 2*a* is provided (see FIGS. 1 and 2). Behind the openable/closable door 2*a*, an attaching section 2*c* is formed. A bottom surface of the attaching section 2*c* defines a sheet feed path 57 for the recording sheet 3, which is fed via a register rollers 9. As shown in FIG. 1, when the process cartridge 12 is fully inserted to a position where the photoconductive drum 21 and the transfer roller 26 face are urged relative to each other (which will be referred to as a mount completed position) so that it is possible to transfer an image on the recording sheet 3, the laser printer 1 is in a mount completed condition.

The feeder unit 4 includes, on a bottom surface of the casing 2, a sheet feed tray 43 which can be detachably mounted, a sheet pressing plate 6 provided inside the sheet feed tray 43, a sheet feed roller 7 and a sheet separation pad 8 which are provided on an upper portion of the leading end portion of the sheet feed tray 43, and a register roller 9 provided on a downstream side, in the sheet feed direction, with respect to the sheet feed roller 7.

The pressing plate 6 is configured such that a plurality of recording sheets 3 are placed thereon in a stacked state, and an end farther from the sheet feed roller 7 is rotatably supported, while the other end closer to the sheet feed roller 7 is rockable in an up and down direction. The pressing plate 6 is urged upward by a spring member (not shown) provided below the pressing plate 6. Therefore, as the stacked amount of the recording sheets 3 increases, the pressing plate 6 rocks downward against the urging force of the spring member, about the side of the pressing plate 6 farther from the sheet feed roller 7. The sheet feed roller 7 and the sheet separation pad 8 are arranged to face each other. By a spring 10 provided on a lower surface of the separation pad 8, it is urged toward the sheet feed roller.

The uppermost sheet 3 of the stack of recording sheets 3 stacked on the sheet pressing plate 6 is press-contacted with the sheet feed roller 7 by the urging force of the spring member (not shown) provided below the pressing plate 6. As the feed roller 7 rotates, the recording sheet 3 is nipped between the sheet feed roller 7 and the sheet separation pad 8, and thereafter, the recording sheets 3 are fed one by one. The recording sheet 3 thus fed is introduced to the register rollers 9. The register rollers 9 include a driving roller 44 provided in the casing 2, and a driven roller 12 provided to a process cartridge. Specifically, the recording sheet 3 fed from the sheet feed roller 7 is nipped between the driving roller 44 and driven roller 45. The position of the recording sheet 3 is adjusted, and then fed to the image forming unit 5.

The image forming unit 5 has a scanner unit 11, a process cartridge 12, a transfer roller 26, and a transfer unit 13.

The scanner unit 11 is provided in an upper portion of the casing 2, and is provided with a laser source (not shown), a polygonal mirror 14 which is driven to rotate, lenses 15 and 16, mirrors 17, 18 and 19. The laser source 11 emits a laser beam, which is emitted based on image data, is transmitted through or reflected by the polygonal mirror 14, a lens 15, mirrors 17 and 18, a lens 16, a reflector 19 in this order so that the laser beam is finally incident on the photoconductive drum 21 of the process cartridge 12 as a high speed scanning beam.

Figure 2:
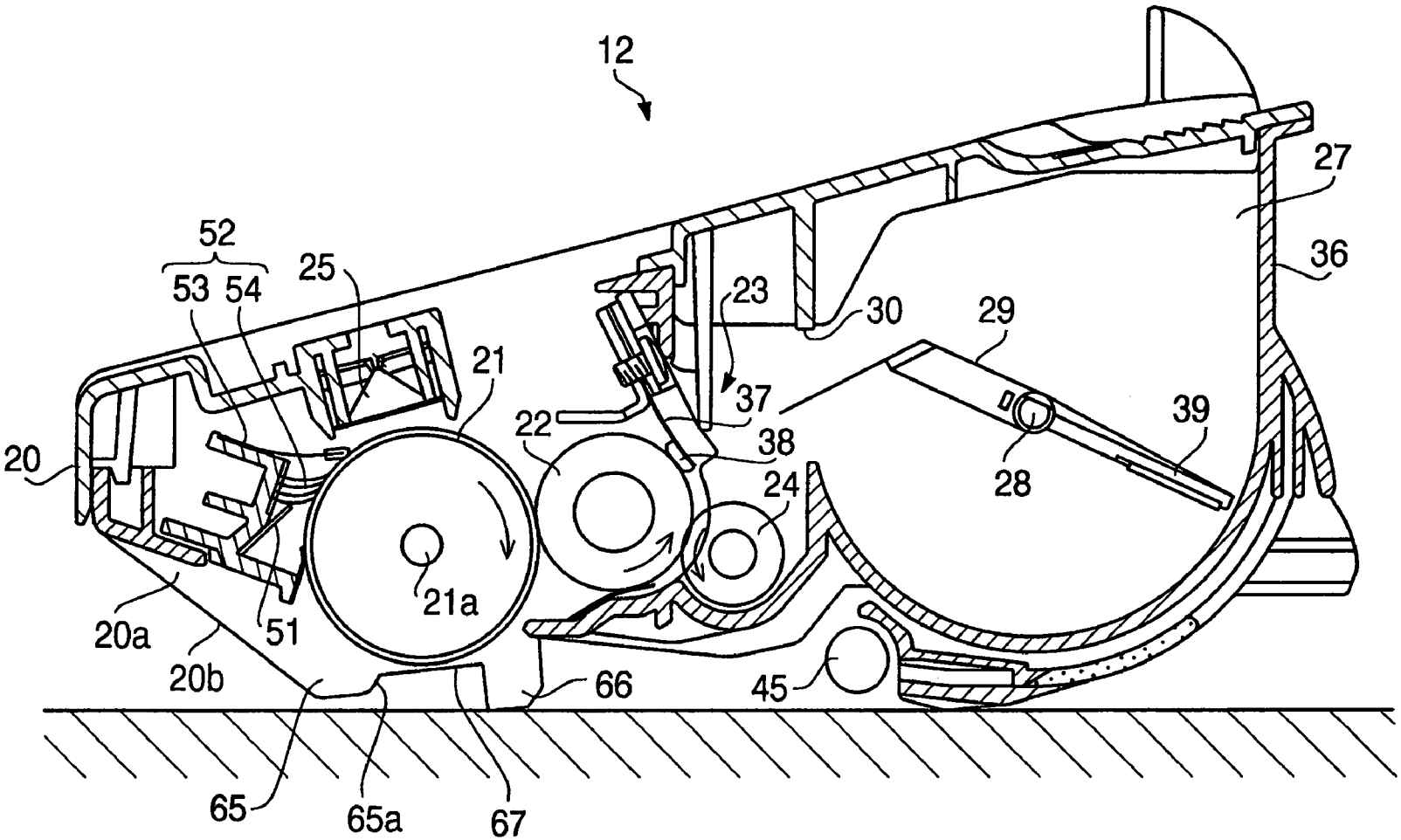
FIG. 2 is an enlarged cross-sectional side view of a process cartridge which can be detachably attached to the laser printer shown in FIG. 1.
Figure 3:
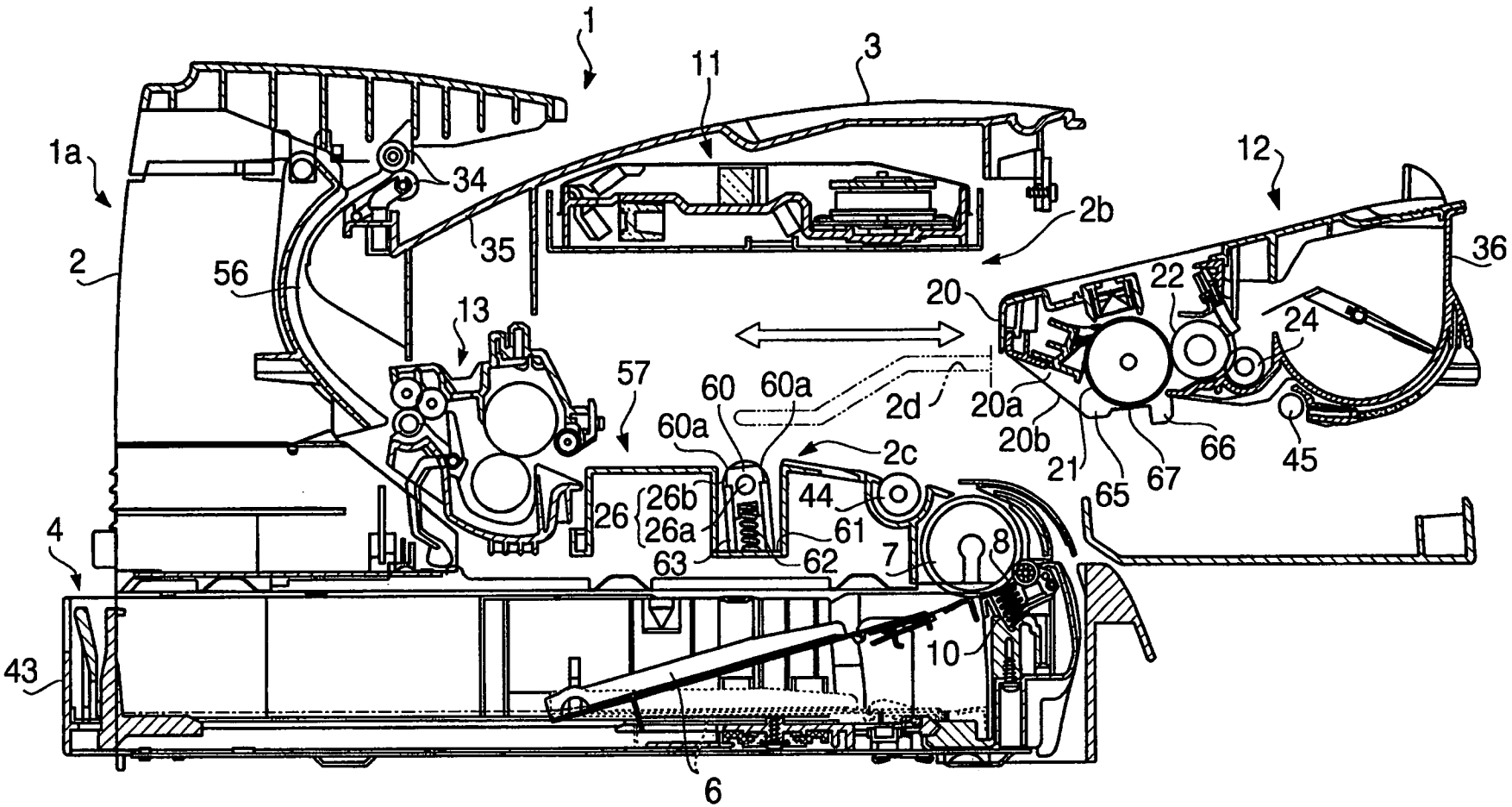
FIG. 3 is a cross-sectional side view showing the main components of the laser printer when the process cartridge is detached.

FIG. 2 is an enlarged cross-sectional side view of the process cartridge 12. The process cartridge 12 is not provided with a transfer roller therein, as shown in FIG. 2. According to the first embodiment, the transfer roller 26 is provided in the main body 1*a* of the laser beam printer 1. According to the first embodiment, the process cartridge 12 is slid to detach from or attach to the main body 1*a* in a direction perpendicular to a direction along which the photoconductive drum 21 and the transfer roller 26 face each other in the mount completion state. Specifically, the process cartridge 12 is, as shown in FIG. 3, inserted in a passage 12*b* substantially along the sheet feed path 57.

As shown in FIG. 2, the process cartridge 12 has a drum cartridge 20 which is detachably attached to the casing 2 at a position below the scanner unit 11. In the drum cartridge 20, the photoconductive drum 21, a developing cartridge 26 and a corona charger 25 of scorotron type. The developing cartridge 36 is detachably attached to the drum cartridge 20, and includes a developing roller 22, a thickness regulating blade 23, a feed roller 24 and a toner box 27.

Nonmagnetic single-component toner having a positive charging characteristic is filled in the toner box 27 as developing agent. Specifically, polymerized toner created by copolymerizing polymerized monomer (such as styrene monomer, or acrylic monomer such as acrylic acid, alkyl acrylates, alkyl meta-acrylates) in accordance with a well-known polymerizing method such as suspension polymerizing method may be used.

The polymerized toner has ball-like particles and high flowability. Typically, a coloring agent such as carbon black and/or wax is added. Further, in order to improve the flowability, an additional agent such as silica may be added. The size of the particle is approximately in the range from 6 μm to 10 μm.

The toner in the toner box 27 is agitated by an agitator 29 supported by a rotary shaft 28, which is provided at the center of the toner box 27. The toner as agitated is discharged from a toner supply opening 30 formed on a side portion of the toner box 27 (see FIG. 2). On a side surface of the toner box 27, a window (not shown) enabling a user to monitor the remaining amount of the toner is provided. The window is cleaned (wiped) with a cleaner 39 which is also supported by the rotary shaft 28.

On a side portion of the toner supply opening 30, a supply roller 24 is provided. The supply roller 24 is rotatable in clockwise direction (in FIG. 2). Facing the supply roller 24, a developing roller 22, which is rotatable in a counterclockwise direction, is provided. The supply roller 24 and the developing roller 22 are press-contacted such that each roller is compressed slightly.

The supply roller 24 is configured such that a metallic roller shaft is covered with a layer of a roller formed of electrically-conductive porous member. The developing roller 22 is configured such that a metallic roller shaft is covered with a layer of a roller formed of electrically-conductive rubber member. Specifically, the roller portion of the developing roller 22 may include a roller body formed of conductive urethane rubber or silicon rubber including fme carbon particles. On the roller body described above, a coating layer formed of urethane rubber or silicon rubber including fluorine may be used. It should be noted that a bias voltage is applied to the developing roller 22 so that it has a predetermined electrical potential with respect to the photoconductive drum 21.

Adjacent to the developing roller 22, a layer thickness regulating blade 23 is provided. The regulating blade 23 includes a blade member 37 formed of a metallic plate spring and a pressing member 38, which is formed of insulating silicon rubber and formed to have a half round cross-sectional shape. A portion of the blade 37, opposite to a portion contacting the pressing member 38, is supported by the developing cartridge 36 at a position adjacent to the developing roller 22. Further, the pressing member 38 is press-contacted against the developing roller 22 by an elastic force of the blade member 37.

The toner discharged from the toner supply opening 30 is, as the supply roller 24 rotates, supplied to the developing roller 22. When the toner is supplied between the supply roller 24 and the developing roller 22, the toner is charged as frictional electrification occurs at that location. That is, the toner supplied onto the developing roller 22 enters a nip between the pressing member 38 and the developing roller 22 as the developing roller 22 rotates and sufficiently charged by friction at that location. The charged toner is carried by the developing roller 22 as a thin layer having a predetermined thickness.

Figure 5A:
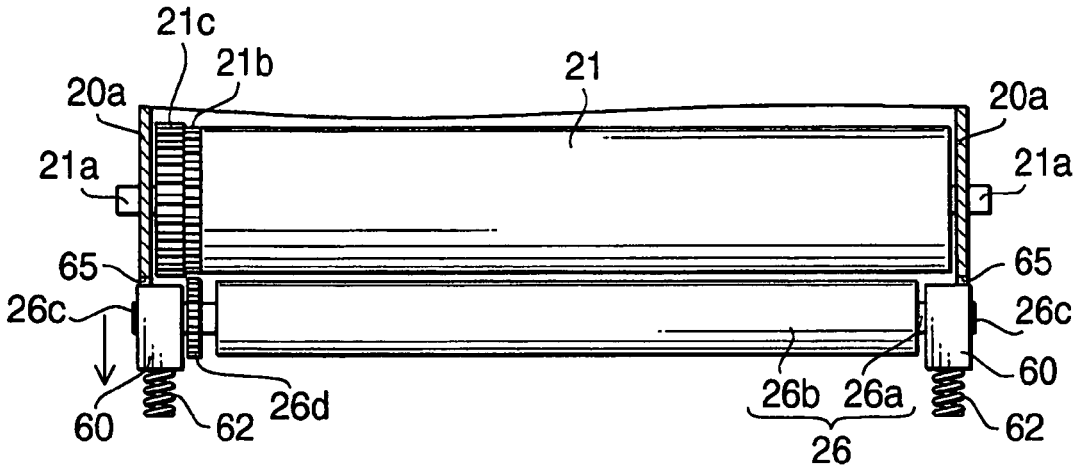
FIGS. 5A-5B is an enlarged rear view of a photoconductive drum and a transfer roller.
Figure 5B:
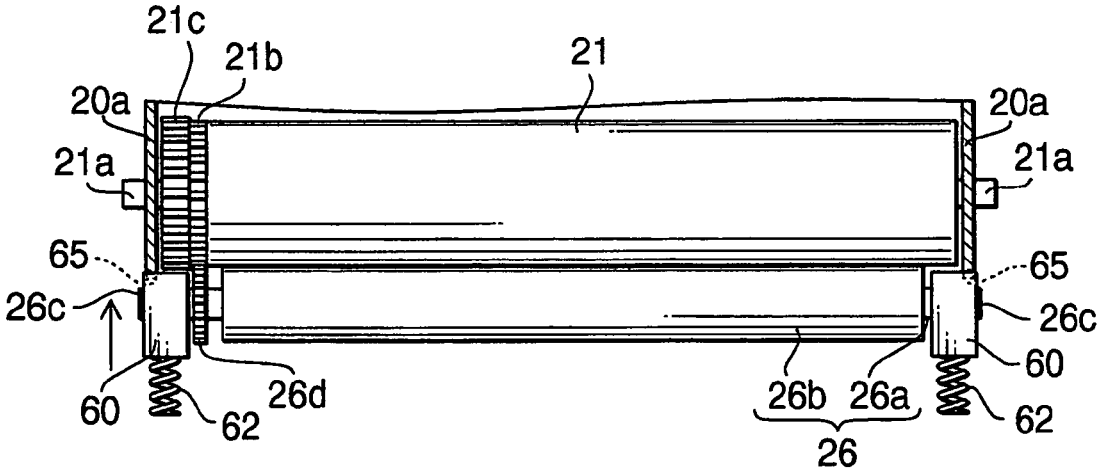

The photoconductive drum 21 is located at a rear side of the developing roller 22 and faces the developing roller 22 with a predetermined clearance therebetween. The photoconductive drum 22 is rotatable in a clockwise direction in FIG. 2. The photoconductive drum 22 is configured such that a main body thereof is grounded (earthed) and a layer of photoconductive material having a positive charging property such as polycarbonate is formed on the circumferential surface of the main body. Further, as shown in FIGS. 5A and 5B, end portions of a roller shaft 21*a* are protruded from both side end surfaces of the photoconductive drum 21, and on one side (left-hand side in FIGS. 5A and 5B) of the protruded portion of the roller shaft 21*a*, a connection gear 21*b* is provided. The connection gear 21*b* engages with a gear 26*d* provided to the transfer roller 26 in the mount completion state. Further, an input gear 21*c*, to which a driving force of a driving motor (not shown) provided in the main body 1*a* is applied, is proved to the side portion of the roller shaft 21 next to the connection gear 21*b*.

The corona charger 25 is arranged above the photoconductive drum 21 with a predetermined distance therebetween so that it does not contact the photoconductive drum 21.

The corona charger 25 is a charger for the positive electrification, and generates a corona discharge from an electrifying wire such as a tungsten wire. As the corona charger 25 is actuated, the circumferential surface of the photoconductive drum 21 is evenly charged to a positive polarity.

After the above charging is effected (i.e., when the circumferential surface of the photoconductive drum 21 is evenly charged), the circumferential surface of the photoconductive drum 21 is exposed to a scanning laser beam, which scans at a high speed, thereby forming on the circumferential surface of the photoconductive drum 21 an electrostatic latent image according to image data. As the developing roller 22 rotates, the toner positively electrified and carried by the developing roller 22 is attracted by the latent image on the photoconductive drum 21 when the developing roller 22 contacts the photoconductive drum 21. That is, the portion of the latent image on the photoconductive drum 21 has a lower potential in comparison with the other portion, which is uniformly charged, of the photoconductive drum 21, and the toner is supplied from the developing roller 22 to the latent image of the circumferential surface of the photoconductive drum 21. With this process, the latent image is developed to a toner image.

Between side walls 20*a* of the drum cartridge 20, a brush unit 52 is provided. The brush unit 52 includes a brush holder 53 which is bridged between the side walls 20*a* and a brush 54. The brush holder 53 also supports a brush supporting plate 51. The brush supporting plate 51 serves to support the brush 54 from the below thereof. The brush 54 is made of electrically conductive material. A bias voltage generated by a high-voltage source (not shown) provided in the main body 1*a* is applied to the brush 54, thereby removing minute paper particles adhered on the circumferential surface of the photoconductive drum 21.

The transfer roller 26 is configured such that a metallic roller shaft 26*a* is covered with a roller 26*b* made of electrically conductive rubber material, the both end portions 26*c*, 26*c* of the roller shaft 26*a* protruding from the end side surfaces of the roller 26*b*, respectively (see FIGS. 5A and 5B). According to the first embodiment, the end portions 26*c*, 26*c* of the roller shaft 26*a* are rotatably supported by a pair of supporting members 60 and 60. Each supporting member 60 is fixed on a recessed portion 61 formed on the bottom surface of the mounting portion 2*c* via a spring 62.

On the bottom surface of the recessed portion 61, guide walls 63 which extend toward the photoconductive drum 21 are provided. The guide walls 63 guide the supporting members 60 in a direction from the bottom surface of the recessed portion 61 toward the photoconductive drum 21, which is in the urging direction of the springs 62. As shown in FIGS. 1, 3 and 4, when the process cartridge 12 is attached to the attaching section 2*c* (in the mount completion state), the supporting members 60 are urged by the springs 62 so that the transfer roller 26 is press-contacted with the photoconductive drum 21. When the process cartridge 12 is detached from the attaching section 2*c*, the transfer roller 26 is slightly protruded upward with respect to the sheet feed path 57. The transfer roller 26 is applied with a transfer bias voltage providing a predetermined potential with respect to the potential on the circumferential surface of the photoconductive drum 21 so that the visible image (i.e., toner image) carried by the photoconductive drum 21 is transferred on a recording sheet 3 when it passes through the nip between the photoconductive drum 21 and the transfer roller 26.

As shown in FIG. 1, the fixing unit 13 is provided on the downstream side of the sheet feed path with respect to the process cartridge 12, and includes a heat roller 32, a press roller 31, which is urged to contact the heat roller 32, and a pair of feeding rollers 33 arranged on the downstream side with respect to the heat roller 32 and the press roller 31. The heat roller 32 is made of metal and provided with a halogen lamp for generating heat. The toner image transferred on sheet 3 is fixed as the sheet 3 passes through the nip between the heat roller 32 and the press roller 31. Then, the sheet 3 is fed to a sheet discharging path 56 by the pair of feeding rollers 33. When fed to the sheet discharging path 56, the sheet 3 is further fed to the discharge rollers 34, and thereby discharged on a discharge tray 35.

The laser printer 1 employs a so-called cleaner-less toner collection method. That is, the residual toner that remains on the circumferential surface of the photoconductive drum 21 after the toner image has been transferred to the recording sheet 3 is collected using the developing roller 22. Since the cleaner-less method is employed, it is not necessary to provide a cleaning device such as a cleaning blade and a waste toner tank for collecting the waste toner to the printer 1. Therefore, according to the first embodiment, the configuration of the laser printer can be simplified, and the size and manufacturing cost can be decreased.

According to the first embodiment, on both walls that face each other at the passage 2*b*, a guide grooves 2*d*, 2*d* are formed. In FIGS. 3 and 4, a right-hand side one viewed from the front side is shown. The guide grooves 2*d* and 2*d* engage with predetermined portions on both sides of the process cartridge (e.g., the end portions of the roller shaft 21*a* of the photoconductive drum 21) to introduce the process cartridge 12 to deep inside (rear side) of the main body 1*a* to the mount completion position. In the mount completion state, the photoconductive drum 21 and the transfer drum 26 are allowed to be press-contacted with each other, while when the process cartridge 12 is not in the mount completion state, the photoconductive drum 21 and the transfer roller 26 are spaced from each other. Specifically, when the process cartridge 12 at the mount completion position is to be detached, a downward force of the process cartridge 12 applied to the attaching section 2*c* (i.e., the force pressing down the process cartridge 12 by the engagement of the guide grooves 2*d* and 2*d* with the both ends of the roller shaft 21*a* of the photoconductive drum 21) is generated, which separates the photoconductive drum 21 and the transfer roller 26 from each other.

The roller shaft 21*a* of the photoconductive drum 21 is supported by the side walls 20*a*, 20*a* of the drum cartridge 20. The lower end of each side wall 20*a* is configured as follows (see FIGS. 2, 5A and 5B). On each side wall 20, at a portion below the photoconductive drum 21, a first extended portion 65 and a second extended portion 66, each of which is integrally formed and extends downward with respect to the portion of the photoconductive drum 21 exposed to the transfer roller 26. The first extended portion 65 and the second extended portion 66 define a dent portion 67 therebetween. The rear end (i.e., the left-hand side end in FIG. 2) of the first extended portion 65 is connected to an inclined surface 20*b* which obliquely extends from the rear end (i.e., the left-hand side end in FIG. 2) of the drum cartridge 20. The front end of the first extended portion 65 is formed to be a tapered surface (curved surface) 65*a*.

As described above, the end portions 26*c* and 26*c* of the roller shaft 26*a* of the transfer roller 26 is rotatably supported by the supporting members 60, 60, which are urged upward by the springs 62. When the process cartridge 12 is being attached or being detached, the lower end portion of each side wall 20*a* of the process cartridge 12 contacts the upper end surface of corresponding supporting member 50. The front and rear side ends of the upper surface are formed to be curved tapered surfaces 60*a*, 60*a* (see FIG. 3).

Figure 4A:
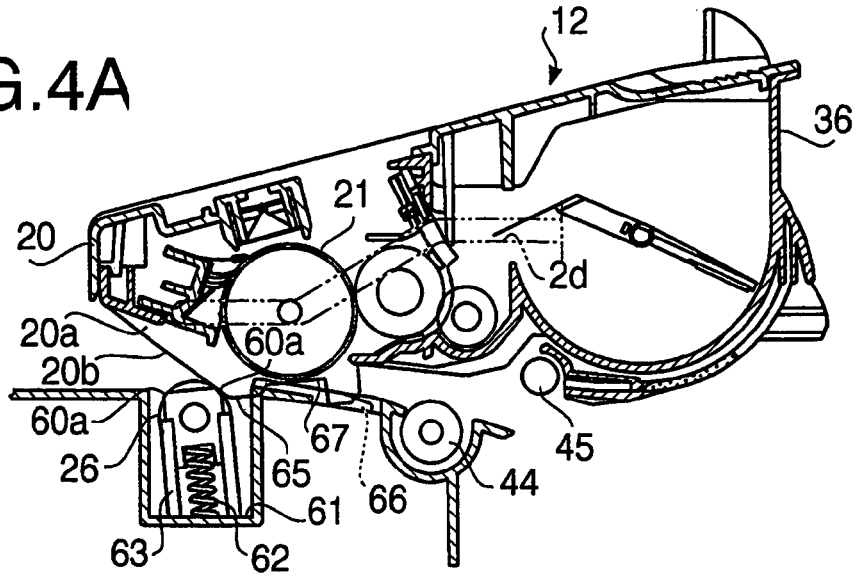
FIGS. 4A-4C show a process of detaching/attaching the process cartridge to the laser beam printer.

As shown in FIG. 3, when the door 2*a* of the main body 1*a* is opened and the process cartridge 12 is inserted in the passage 2*b*, the inclined surface 20*b* of each side wall 20*a* of the drum cartridge 20 contacts the tapered surface 60*a* on the front side of each supporting member 60 as shown in FIG. 4A. When the process cartridge 12 is further inserted rearward, with the end portions of the roller shaft 21*a* being guided by the guide grooved 20*a*, the inclined surface 20*b* and the tapered surface 60*a* engage with the supporting members 60. Then, the supporting members 60 are gradually moved downward against the upward urging force of the springs 62.

Figure 4B:
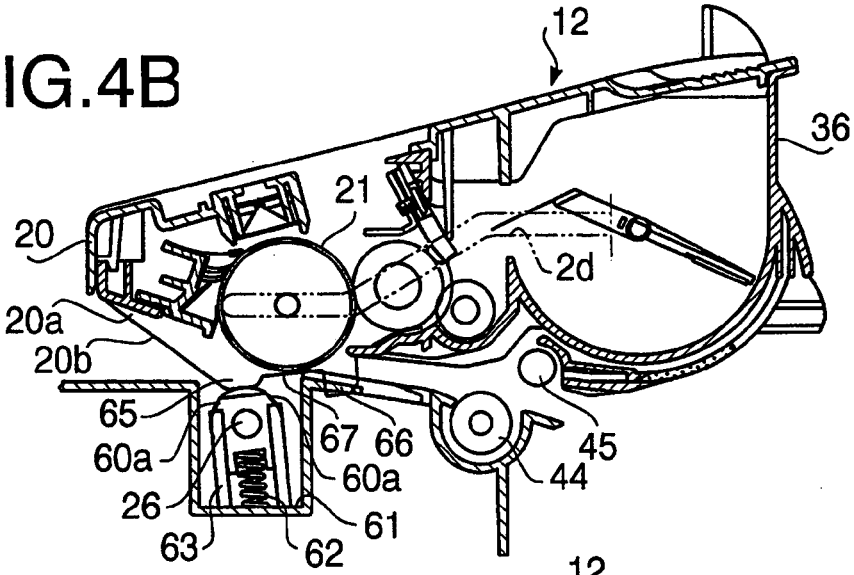

FIG. 4B shows a state where the lowermost surface of the first extended portion 65 contacts the upper surface of the supporting member 60, thereby the photoconductive drum 21 and the transfer roller 26 are spaced from each other. It should be noted that, when in the state shown in FIG. 4B, the process cartridge has not yet be completely attached to the main body 1*a*, and the connection gear 21*b* of the photoconductive drum 21 and the gear 26*d* of the transfer roller 26 have not yet engaged with each other.

Figure 4C:
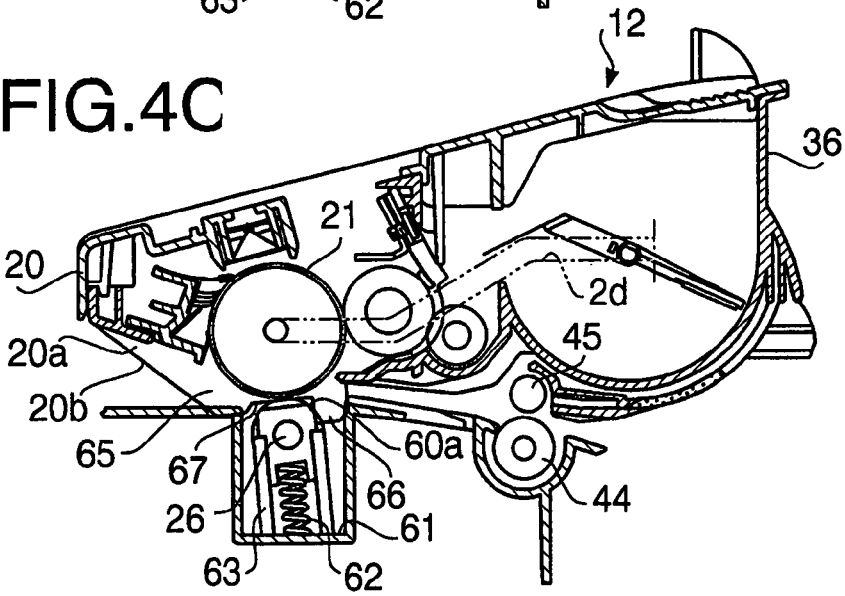

When the process cartridge 12 is further inserted rearward, as shown in FIG. 4C, the upper end portion of each supporting member 60 fitted in the dent portion 67 of the corresponding side wall 20*a*. At this stage, the photoconductive drum 21 and the transfer roller 26 face each other and are press-contacted with each other. The above state is the mount completed state. In this state, the connection gear 21*b* of the photoconductive drum 21 and the gear 26*d* of the transfer roller 26 engage with each other (see FIG. 5B). Accordingly, when the photoconductive drum 21 rotates, the transfer roller 26 also rotates.

Further, in this state, the upper end portions of the supporting members 60 do not contact the dent portions 67 of the side walls 20*a*. With this configuration, the pressing force of the process cartridge (due to the sliding movement along the guide grooves 2*d*) and the urging force of the springs 62 increase the pressing force between the photoconductive drum 21 and the transfer roller 26, which provides the nip therebetween in a stable state.

Because of the tapered surface 65*a* of the first extended portion 65 of each side wall 20*a* and the tapered surface 60*a* of the rear end side of each supporting member 60, the upper portion of the supporting member 60 is moved into the dent portion 67 gradually as the processing cartridge 12 is inserted. Further, the position in the front and rear direction of the upper portion of each supporting member 60 is adjusted as it is sandwiched between the first extended portion 65 and the second extended portion 66.

When the process cartridge 12 is detached, due to the contact between the upper portion of the supporting members 60 and the first extended portions 65 of the side walls 20*a* (see FIGS. 4C and 4B), the press-contacted state between the photoconductive drum 21 and the transfer roller 26 is released (i.e., the transfer roller 26 and the photoconductive drum 21 are separated from each other). Therefore, the process cartridge 12 can be detached from the main body 1*a* with preventing the sliding contact between the photoconductive drum 21 and the transfer roller 26.

According to the first embodiment described above, when the process cartridge 12 is fully inserted in the main body 1*a*, the photoconductive drum 21 and the transfer roller 26 are press-contacted with each other. When the process cartridge 12 is not in the mount complete state, by the pressing force applied by the process cartridge 12, the photoconductive drum 21 and the transfer roller 26 are separated. Therefore, only by the detaching/attaching operation of the process cartridge 12, the contact/separated states between the photoconductive drum 21 and the transfer roller 26 are appropriately set. Thus, the first embodiment enables the user to detach/attach the process cartridge with a simple operation. Further, the first embodiment also provides a simple configuration.

In the mount completed state, the upper end of each supporting member 60 does not contact the dent portion of the corresponding side wall 20*a*. Thus, the pressing force generated by the process cartridge and urging force of the spring 62 applied to the supporting member 60 are effectively used for the press-contact between the photoconductive drum 21 and the transfer roller 26, and the nip therebetween is provided in a stable state.

Further, when in a non-mounted state (i.e., when the process cartridge 12 is not set to the mount completed position), the pressing force provided by the process cartridge 12 moves the supporting members 60 against the urging force of the springs 62, thereby the photoconductive roller 21 and the transfer roller 26 are separated from each other and the nipped state is released. With such a configuration, a locus of the process cartridge 12 in a direction where the photoconductive drum 21 and the transfer roller 26 are separated is unnecessary since the supporting members 60 are movable. Thus, the configuration according to the first embodiment contributes to downsizing of the laser printer 1.

Furthermore, only by attaching/detaching the process cartridge 12 with respect to the main body 1*a*, the engagement of the connection gear 21*b* with the gear 26*d* can be made/released at the same time, which is very convenient. Therefore, the operability of the laser printer 1 is improved.

In the mount completed state, the upper end portions of the supporting members 60 are appropriately positioned in the front and rear direction as they are sandwiched between the first extended portions 65 and the second extended portions 66, respectively. Therefore, the photoconductive drum 21 and the transfer roller 26 are faces and are press-contacted with each other in an appropriate manner.

As shown in FIG. 2, when the process cartridge 12 is placed on a certain place (e.g., on a desk), the first extended portion 65 or the second extended portion 66 of each side wall 20*a* contacts the surface of the desk and the photoconductive drum 21 will not directly contact the surface of the desk. Thus, with this configuration, such a damage can be avoided.

During a process of attaching the process cartridge 12 to the main body 1*a*, due to the engagement between the tapered surface 65*a* at the rear end of the first extended portion 65 of each side wall 20*a* and the tapered surface 60*a* of the front end of each supporting member 60, the upper portion of the supporting members 60 gradually fit in the dent portions 67. Accordingly, the photoconductive drum 21 is gradually pressed to the transfer roller 26. Further, with this configuration, the attaching operation can be done smoothly.

SECOND EMBODIMENT

Figure 6:
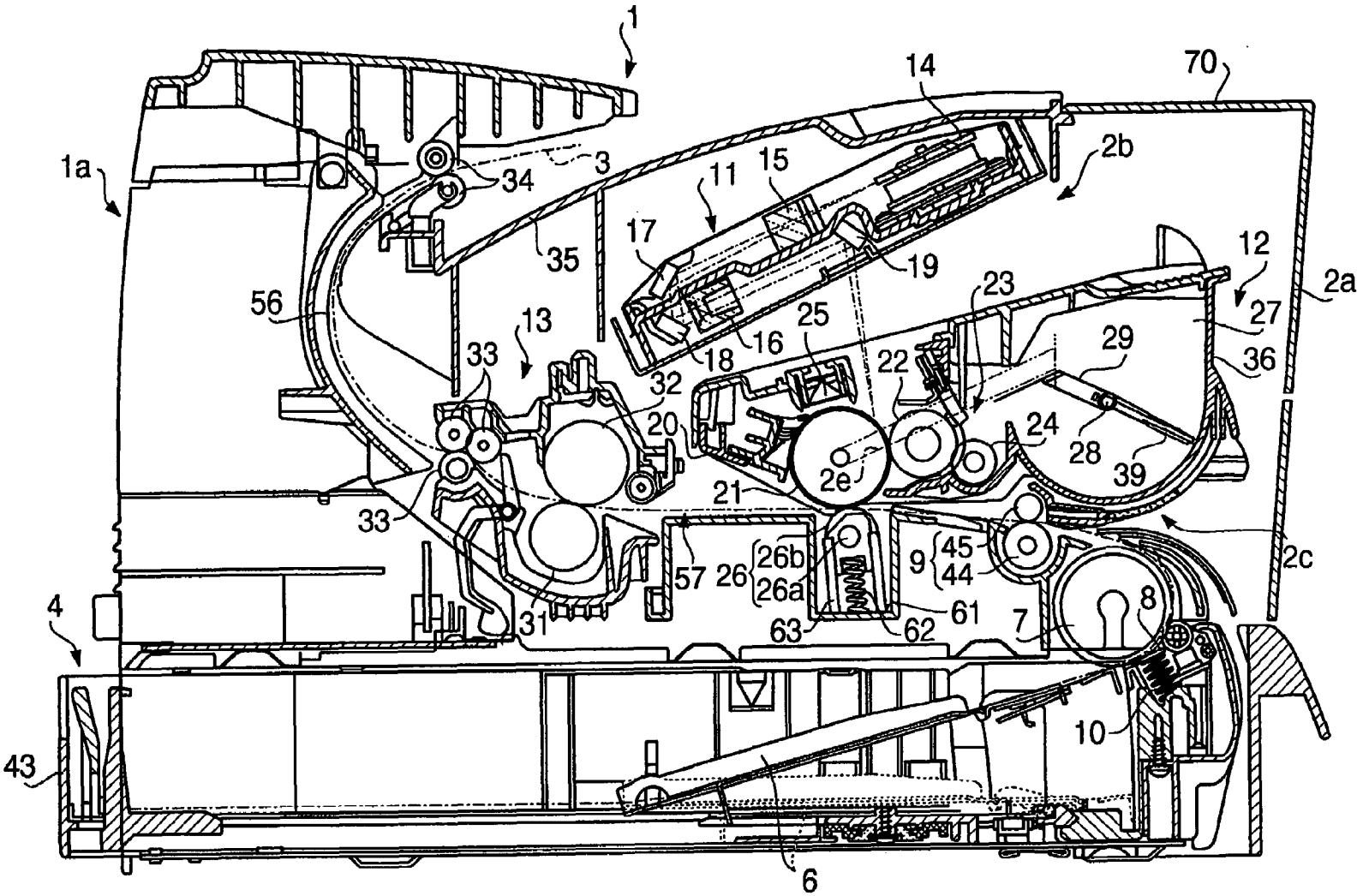
FIG. 6 is a cross-sectional side view showing main components of a laser printer according to a second embodiment.
Figure 7:
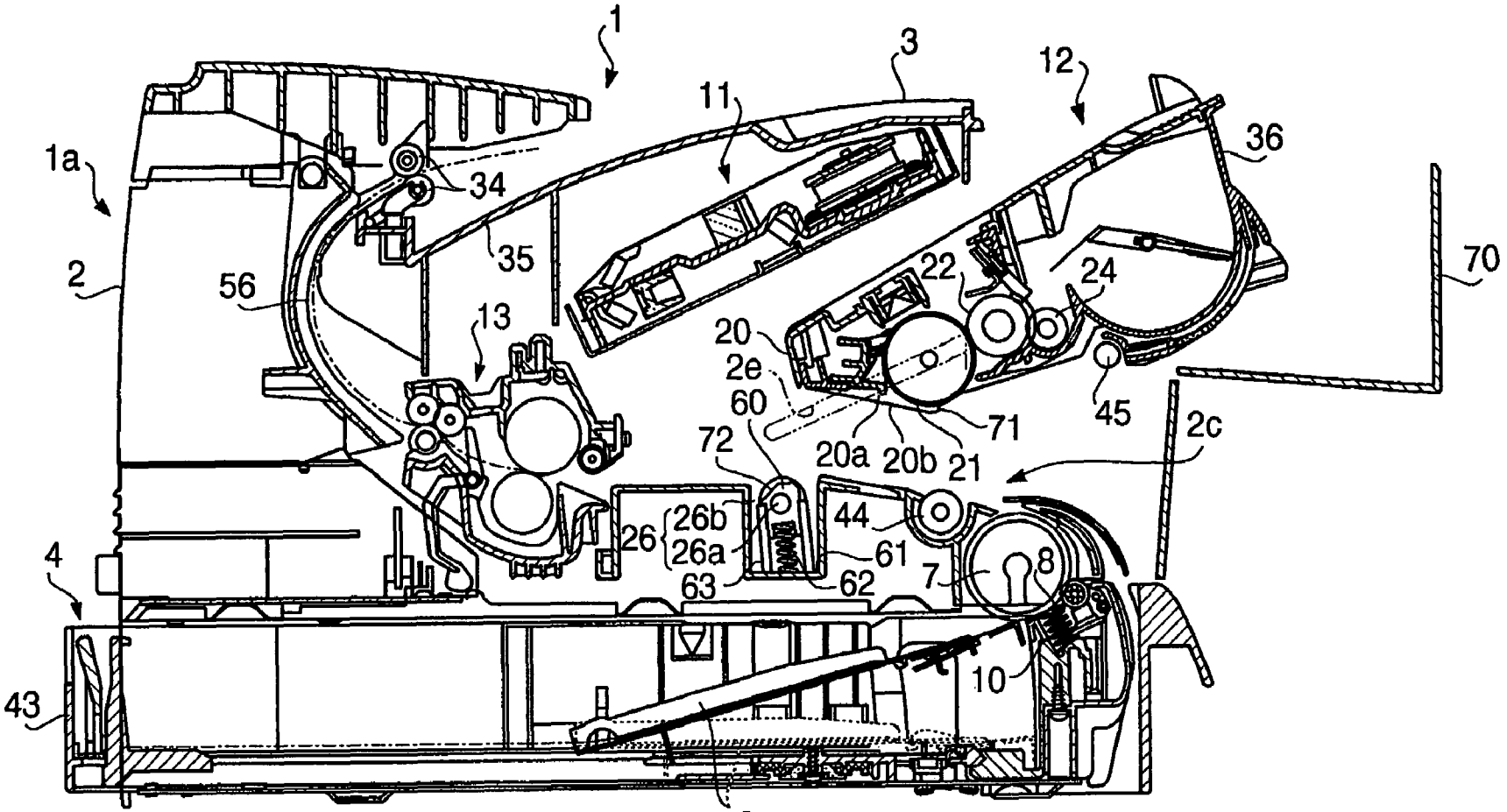
FIG. 7 is an enlarged cross-sectional side view showing the main components when the process cartridge is detached.

FIG. 6 is a cross-sectional side view showing main components of a laser printer 1A according to a second embodiment, and FIG. 7 is an enlarged cross-sectional side view showing the main components when the process cartridge is detached. The laser printer 1A is substantially similar to the laser printer 1 according to the first embodiment except that process and configuration of attaching/detaching the process cartridge 12 are different. Therefore, components of the laser printer 1A similar to those in the laser printer 1 are indicated with the same reference numbers and description thereof will be omitted for brevity. Similar to the first embodiment, in FIGS. 6 to 9, the front side of the laser printer 1A is the left-hand side of each drawing.

As shown in FIGS. 6 and 7, according to the second embodiment, the openable/closable door 70 is configured to be rotated about the lower end portion thereof so that it covers/uncovers the upper portion of the front end side and the front end portion of the upper surface. The process cartridge 12 is obliquely inserted such that the rear end there of is lowered. When the process cartridge 12 is inserted to a predetermined position indicated in FIG. 9A, the process cartridge 12 is inclined such that the front end thereof is moved downward. Then, the mounting state of the process cartridge 12 is in the mount completed state (see FIGS. 6 and 9B).

Figure 8:
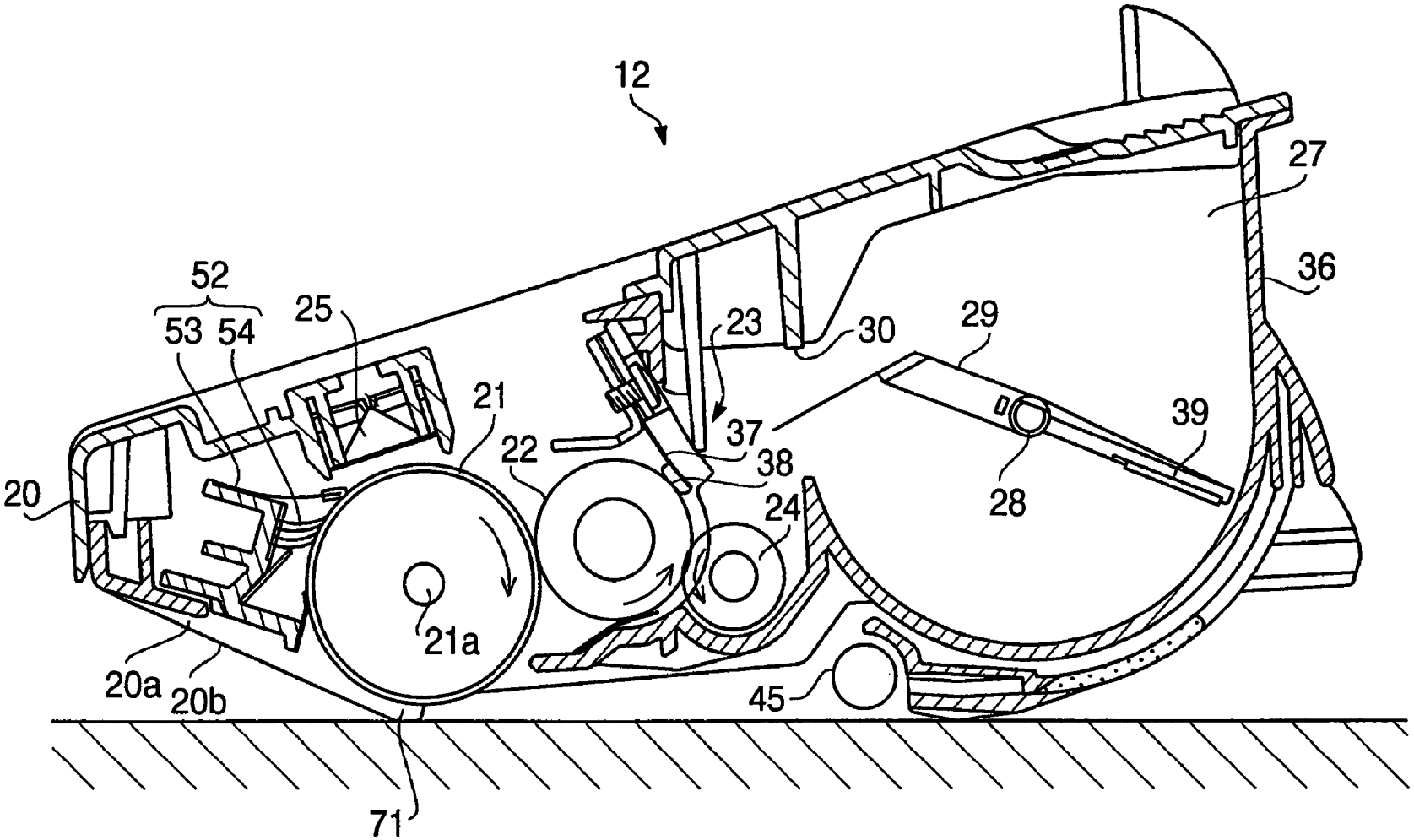
FIG. 8 is an enlarged cross-sectional side view of the process cartridge.

According to the second embodiment, as shown in FIG. 8, each of the side walls 20*a* of the drum cartridge 20 has a protruded portion 71, which is located substantially below the roller shaft 21*a* of the photoconductive drum 21, protruded downward with respect to the lowermost position of the circumferential surface of the photoconductive drum 21, and connected from the inclined surface 20*b* which obliquely extends downward from the upper rear side of the drum cartridge 20.

As shown in FIG. 6, according to the second embodiment, the supporting members 60 are slightly different from the first embodiment. That is, the rear side tapered surface 72 of each of the supporting member 60 is formed to begin from a substantially central position of the upper surface of the supporting member 60.

Figure 9A:
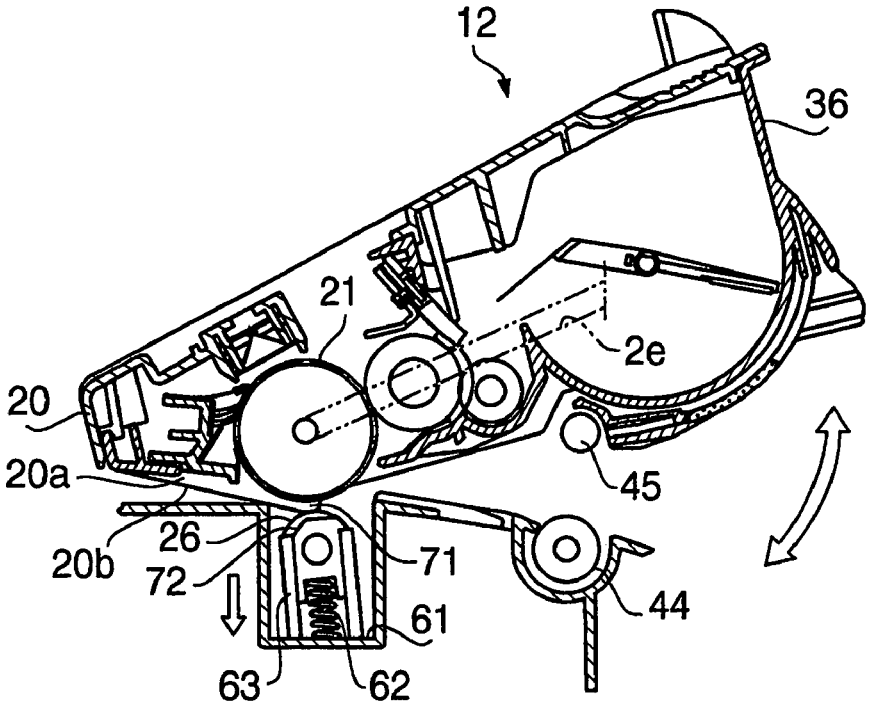
FIGS. 9A and 9B show a process of detaching/attaching the process cartridge.

When the process cartridge 12 is inserted in the attaching portion, the openable/closable door 70 is opened. When the process cartridge 12 is inserted, as shown in FIG. 9A, the protruded portions 71 of the process cartridge 12 contact the upper surfaces of the supporting members 60, and the side ends of the roller shaft 21*a* engage with guide grooves 2*e* shown in FIGS. 7, 9A and 9B (only right side groove viewed from the front is indicated in each drawing). As the process cartridge 12 is inserted, due to the engagement between the roller shaft 21*a* and the guide grooves 2*e*, the supporting members 60 are pressed down, against the biasing force of the springs 62, by the protruded portions 71, respectively. With this configuration, the photoconductive drum 21 and the transfer roller 26 are kept separated (i.e., contact of the photoconductive drum 21 and the transfer roller 26 is prevented). It should be note that the state shown in FIG. 9A is not the mount completed state.

Figure 9B:
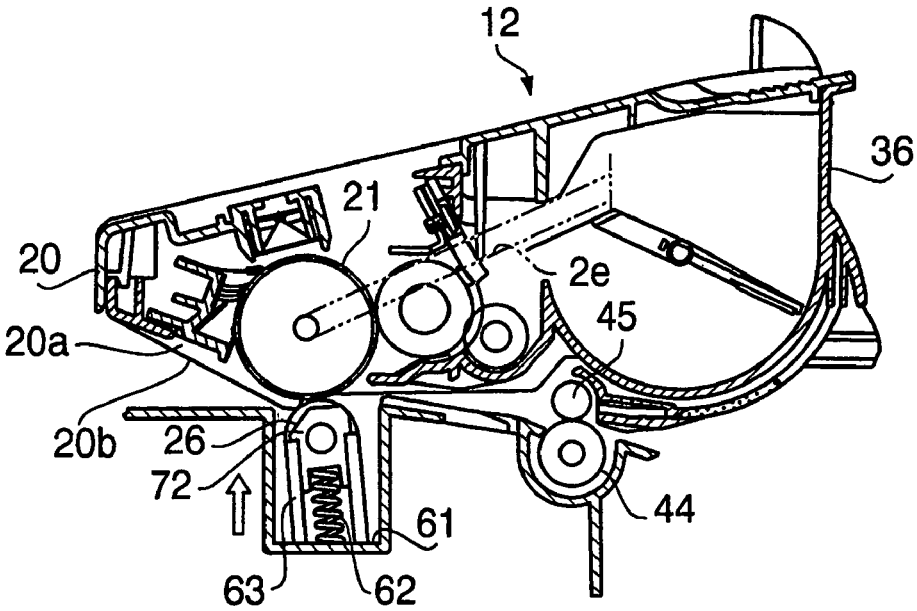

When the process cartridge 12 is inserted to a position as shown in FIG. 9A, the front side end (i.e., left-hand side end) of the process cartridge 12 is moved down. Since the roller shaft 21*a* of the process cartridge 12 engages with the grooves 2*e*, the process cartridge 12 rotates about the roller shaft 12 in the clockwise direction as shown in FIG. 9B. When the process cartridge 12 is fully rotated in the clockwise direction, the driving roller 44 and the driven roller 45 are press-contacted with each other. This state shown in FIG. 9B is the mount completed state in the second embodiment. In this state, the upper surface of each of the supporting members 60 is not engaged with the protruded portion 71 of each side wall 20*a*. Therefore, the transfer roller 26 faces and is press-contacted with the photoconductive drum 21 as it fully receives the urging force of the springs 62. Similar to the first embodiment, in the mount completed state, the supporting members 60 do not contact the side walls 20*a* so that the transfer roller 26 is press-contacted with the photoconductive drum 21 with a sufficient biasing force.

As described above, the second embodiment is configured such that the process cartridge 12 is rotated about the rear end side portion (e.g., the roller shaft 21*a* of the photoconductive drum 21), and the process cartridge 12 is set to the mount completed state with respect to the attaching section 2*c*. When the process cartridge 12 is not in the mount completed state, the protruded portions 71 contact the upper surfaces of the supporting members 60, thereby the photoconductive drum 21 and the transfer roller 26 are separated. When the process cartridge 12 is set to the mount completed state, the photoconductive drum 21 and the transfer roller 26 are press-contacted. Therefore, only by the attaching/detaching operations of the process cartridge 12, the photoconductive drum 21 and the transfer roller 26 are press-contacted/separated. According to the second embodiment, with a relative simple structure, the attaching/detaching operations of the process cartridge can be done with protecting the photoconductive drum 21.

As shown in FIG. 8, when the process cartridge 12 is placed on a certain place (e.g., on a desk), the protruded portion 71 of each side wall 20*a* contacts the surface of the desk and the photoconductive drum 21 will not directly contact the surface of the desk. Thus, with this configuration, a damage of the surface of the photoconductive drum due to direct contact with the desk surface can be avoided.

It should be noted that the present invention need not be limited to the above described illustrative embodiments, and various modification as indicated below are also included in the scope of the invention.

In the above-described embodiments, the transfer roller 26 is urged toward the photoconductive roller with the urging force of the springs 62. It should be noted that the transfer roller 26 may be configured to be located at a fixed position and the photoconductive drum 21 is moveable depending on the position of the process cartridge 12. Alternatively, it may be possible that the transfer roller and/or the photoconductive drum is simply moved between a contacted position and a separated position depending on whether the process cartridge has been completely attached or it is being attached/detached without employing an urging member.

In the above-described embodiments, the dent portion is formed on the process cartridge, while the protruded portion is provided to the main body 1*a*. It is possible to provide the dent portion to the main body 1*a* and the protruded portion on the process cartridge.

THIRD EMBODIMENT

Figure 10:
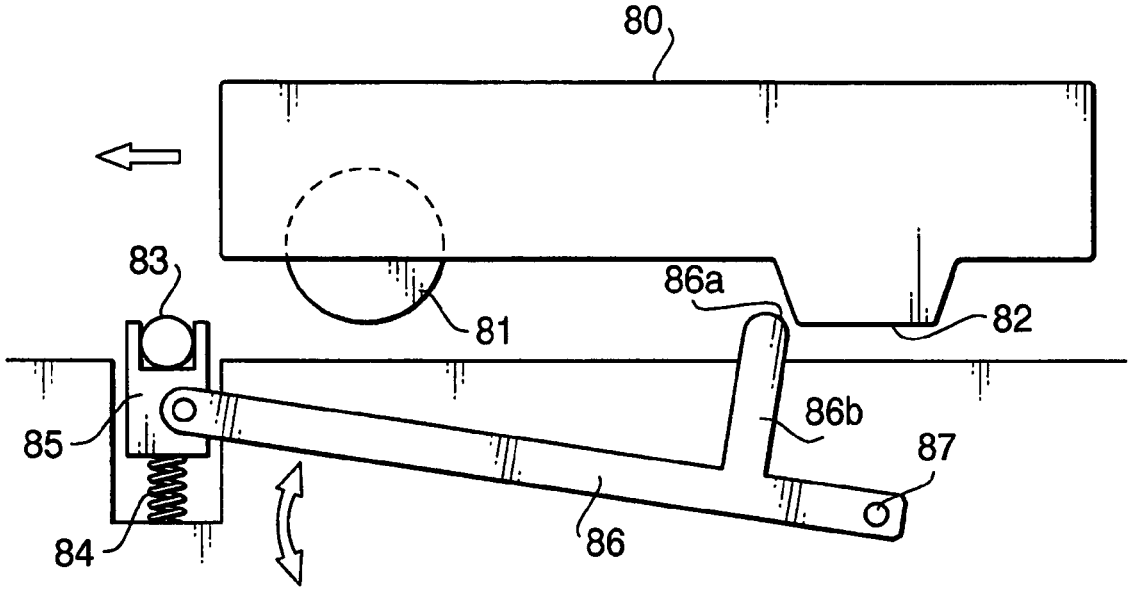
FIG. 10 is a diagram showing a modification of the embodiments.

FIG. 10 schematically shows a configuration according to a third embodiment. In this embodiment, a process cartridge 80 is configured the have a protruded portion 82 on a front side (i.e., right-hand side) of a photoconductive drum 81. A transfer roller 82 is supported by a supporting member 85, which is urged upward by a spring 84. The uppermost portion of the transfer roller 83 and the lower most portion of the photoconductive drum 81 are designed such that the transfer roller 83 is press-contacted with the photoconductive drum 81 in a neutral state. The supporting member 85 is connected to a T-shaped member 86. The T-shaped member 86 is configured to rotate about an axis 87. A central arm 86*b* extends in a substantially vertical direction. When the process cartridge 80 is moved lefiward from a state shown in FIG. 10, an end portion 86*a* of the central arm 86*b* of the T-shaped member 86 contacts the protruded portion 82 of the process cartridge 80. Then, the T-shaped member 86 rotates counterclockwise about the axis 87, thereby moving the supporting member 85 downward (i.e., the transfer roller 83 is separated from the photoconductive drum 81). When the process cartridge 80 is further moved leftward to a position where the photoconductive drum 81 face the transfer roller 83, engagement between the end portion 86*a* and the protruded portion 82 is released (i.e., the protruded portion 82 is located on the left side of the end portion 86*a*), and the supporting member 85 is moved upward by the urging force of the spring 84, thereby the transfer roller being press-contacted with the photoconductive drum 81. When the process cartridge 80 is detached, firstly the protruded portion 82 contacts the end portion 86*a* of the central arm 86*b*, and the T-shaped member 86 rotates counterclockwise, thereby separating the transfer roller 83 from the photoconductive drum 81.

What is claimed is:

1. An image forming device, comprising:

a process cartridge having a image carrying member;

a main body including an attaching section to which the process cartridge is detachably attached, and an image transfer member to be press-contacted to the image carrying member for image transfer when the process cartridge is completely attached to the attaching section, wherein the process cartridge is configured to apply a pressing force to the attaching section when the process cartridge is not completely attached to the attaching section, and wherein the image forming device further comprising a separating mechanism configured to allow the press-contact between the image carrying member and the image transfer member when the process cartridge is completely attached to the attaching section, the separating mechanism operating to separate the image carrying member and the image transfer member when the pressing force is applied by the process cartridge to the attaching section, wherein the separating mechanism includes:

a protruded portion provided to one of the process cartridge and the main body; and a dent portion provided to the other the process cartridge and the main body;

wherein the press-contact between the image carrying member and the image transfer member is allowed when the protruded portion enters the dent portion as the process cartridge is completely attached to the attaching section, and wherein the image carrying member and the image transfer member is separated when the protruded portion interferes with a portion next to the dent portion as the process cartridge is not completely attached to the attaching section.

2. The image forming device according to claim 1, wherein the pressing force is not applied to the attaching section when the process cartridge is completely attached to the attaching section.

3. The image forming device according to claim 1, wherein the main body includes:

a supporting member that supports the transfer member; and an urging member that urges the supporting member in a direction where the image transfer member is urged toward the image carrying member, wherein the separating mechanism moves the supporting member against the urging force of the urging member to separate the image transfer member from the image carrying member.

4. The image forming device according to claim 1, wherein the process cartridge is moved, for attachment/detachment, in a direction substantially perpendicular to a direction in which the image carrying member and image transfer member face each other when the process cartridge is completely attached to the attaching section.

5. The image forming device according to claim 4, wherein the transfer member transfers an image carried by the image carrying member on a recording medium fed on the image transfer member, and wherein the process cartridge is moved in a direction parallel with the feeding direction of the recording medium when attached to or detached from the attaching section.

6. The image forming device according to claim 1, wherein the process cartridge is moved to rotate about an axis that is parallel with a plane on which the image carrying member and the image transfer member are to be press-contacted so as to be completely attached to the attaching section.

7. The image forming device according to claim 1, wherein the image carrying member and the image transfer member respectively have rotatable rollers having rotary axes extending in a predetermined same direction, wherein the rollers are provided with gears that engage with each other when the process cartridge is completely attached to the attaching section, and wherein the gears of the rollers are disengaged when the process cartridge is not completely attached to the attaching section.

8. The image forming device according to claim 1, further comprising a positioning structure that adjusts positions of the image carrying member and the image transfer member when the process cartridge is completely attached to the attaching section.

9. The image forming device according to claim 1, wherein the main body is provided with:

a supporting member that supports the transfer member; and an urging member that urges the supporting member in a direction in which the image transfer member faces the image carrying member, the protruded portion being provided to the supporting member, and the dent portion being provided to the process cartridge.

10. The image forming device according to claim 1, wherein the protruded portion is provided to the process cartridge, the protruded portion being protruded outward with respect to an outermost portion of the image carrying member.

11. The image forming device according to claim 1, wherein the dent portion is defined as a portion between two protruded sections, a relative position between the image carrying member and the image transfer member in a direction in which to protruded sections are arranged being adjusted by the two protruded sections when the protruded portion engages with the dent portion as the process cartridge is completely attached to the attaching section.

12. The image forming device according to claim 1, wherein at least one of the protruded portion and the dent portion is formed with a tapered surface which enables the image carrying member and the image transfer member to gradually approach when an attaching state of the process cartridge is changed from a non-attached state to a completely attached state.

13. A process cartridge to be detachably attached to an attaching section of a main body of an image forming device, the process cartridge comprising an image carrying member which is to be press-contacted with an image transfer member provided to the main body when the process cartridge is completely attached to the attaching section, wherein a protruded portion is provided to one of the process cartridge and the main body, wherein a dent portion is provided to the other of the process cartridge and the main body, wherein the press-contact between the image carrying member and the image transfer member is allowed when the protruded portion enters the dent portion as the process cartridge is completely attached to the attaching section, and wherein the image carrying member and the image transfer member is separated when the protruded portion interferes with a portion next to the dent portion as the process cartridge is not completely attached to the attaching section.

14. A process cartridge to be detachably attached to an attaching section of a main body of an image forming device, the process cartridge comprising:

a image carrying member which is to be press-contacted with an image transfer member provided to the main body when the process cartridge is completely attached to the attaching section; and a dent portion in which a protruded portion provided to the main body is inserted when the processing cartridge is completely attached to the attaching section, the image carrying member being press-contacted when the protruded portion is inserted in the dent portion, wherein the protruded portion contacting side portions defining the dent portion when the processing cartridge is not completely attached to the attaching section, the image carrying member and the image transfer member being spaced from each other when the protruded portion contacts the side portions defining the dent portion.

15. The process cartridge according to claim 14, wherein the protruded portion and the dent portion do not contact each other when the process cartridge is completely attached to the attaching section.

16. The process cartridge according to claim 14, wherein the process cartridge is moved to be attached to or detached from the main body along a direction perpendicular to a direction in which the image carrying member and the image transfer member face each other when the process cartridge is completely attached to the attaching section.

17. The process cartridge according to claim 16, which is inserted to the attaching section along a direction parallel with a feeding direction of a recording medium fed on the image transfer member.

18. The process cartridge according to claim 14, which is attached to the attaching section by a rotation about a side end thereof.

19. The process cartridge according to claim 14, wherein the image carrying member and the image transfer member respectively have rotatable rollers having rotary axes extending in a predetermined same direction, wherein the rollers are provided with gears that engage with each other when the process cartridge is completely attached to the attaching section, and wherein the gears of the rollers are disengaged when the process cartridge is not completely attached to the attaching section.

20. The process cartridge according to claim 14, wherein the protruded portion and the dent portion are shaped to engage with each other when the process cartridge is completely attached to the attaching section, and wherein a positional relationship between the image carrying member and the image transfer member in a direction in which a recording medium is fed on the image transfer member is adjusted by the engagement between the protruded portion and the dent portion.

21. The process cartridge according to claim 14, wherein at least one of the protruded portion and the dent portion is formed with a tapered surface which enables the image carrying member and the image transfer member to gradually approach when an attaching state of the process cartridge is changes from a non-attached state to a completely attached state.

22. An image forming device, comprising:

a process cartridge having an image carrying member;

a main body having including an attaching section to which the process cartridge is detachably attached;

an image transfer member supported at the main body, the image transfer member being movable between a first position where the image transfer member is contacted to the image carrying member and a second position where the image transfer member is separated from the image carrying member; and a separating mechanism that communicates with the process cartridge and makes the image transfer member positioned at the second position when the process cartridge is adjacent to the attaching section while the process cartridge is being attached to and being detached from the attaching section;

wherein the separating mechanism includes:

a protruded portion provided to one of the process cartridge and the main body; and a dent portion provided to the other of the process cartridge and the main body;

wherein the press-contact between the image carrying member and the image transfer member is allowed when the protruded portion enters the dent portion as the process cartridge is completely attached to the attaching section, and wherein the image carrying member and the image transfer member is separated when the protruded portion interferes with a portion next to the dent portion as the process cartridge is not completely attached to the attaching section.

* * * * *